US010094338B2

(12) United States Patent
Lee

(10) Patent No.: US 10,094,338 B2
(45) Date of Patent: Oct. 9, 2018

(54) COMBINATION STRUCTURE OF EGR COOLER

(71) Applicant: Hyundai Motor Company, Seoul (KR)

(72) Inventor: Seung Hyun Lee, Gimcheon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/346,003

(22) Filed: Nov. 8, 2016

(65) Prior Publication Data

US 2018/0023520 A1 Jan. 25, 2018

(30) Foreign Application Priority Data

Jul. 20, 2016 (KR) ..... 10-2016-0091911

(51) Int. Cl.

| | |
|---|---|
| ***F02M 26/30*** | (2016.01) |
| ***F02M 26/29*** | (2016.01) |
| ***F02M 26/31*** | (2016.01) |
| ***F02M 26/32*** | (2016.01) |
| *F02M 26/27* | (2016.01) |
| *F02M 26/28* | (2016.01) |
| *F28F 9/04* | (2006.01) |

(52) U.S. Cl.

CPC ..... *F02M 26/29* (2016.02); *F02M 26/30* (2016.02); *F02M 26/31* (2016.02); *F02M 26/32* (2016.02); *F02M 26/27* (2016.02); *F02M 26/28* (2016.02); *F28F 9/04* (2013.01); *F28F 2275/067* (2013.01)

(58) Field of Classification Search

CPC .. F01N 2260/024; F01N 2270/02; F28F 9/04; F28F 9/18; F28F 9/182; F28F 9/185; F28F 2275/067; F28F 9/268; F02M 26/29–26/32

USPC ..... 123/568.12

See application file for complete search history.

(56) References Cited

U.S. PATENT DOCUMENTS

| | | | | |
|---|---|---|---|---|
| 7,121,325 | B2 * | 10/2006 | Kruger | F28F 9/02 165/51 |
| 9,377,252 | B2 * | 6/2016 | Garret | F28D 7/1684 |
| 9,938,935 | B2 * | 4/2018 | Bailey | F02M 26/30 |
| 2002/0162651 | A1 * | 11/2002 | Nakagome | F28F 9/0229 165/158 |
| 2010/0175861 | A1 * | 7/2010 | Ma | F28D 1/05366 165/173 |

(Continued)

FOREIGN PATENT DOCUMENTS

| | | |
|---|---|---|
| JP | 2000-213425 A | 8/2000 |
| JP | 3804727 B2 | 8/2006 |

(Continued)

*Primary Examiner* — Sizo Vilakazi
*Assistant Examiner* — Kevin R Steckbauer
(74) *Attorney, Agent, or Firm* — Morgan, Lewis & Bockius LLP

(57) ABSTRACT

A combination structure of an Exhaust Gas Recirculation (EGR) cooler may include a housing open at both sides thereof, a plurality of headers inserted in both of the sides of the housing and having a circumference forming a layer with the housing, and a plurality of diffusers each including a coupling portion, which is inserted in the headers to form a layer with the housing and the headers, at a first side and having a hole for receiving and discharging exhaust gas at a second side, in which sides of the housing and the headers may be welded, and the housing, the circumference of the headers, and coupling portions of the diffusers may be welded.

2 Claims, 2 Drawing Sheets

(56) References Cited

U.S. PATENT DOCUMENTS

| | | | | |
|---|---|---|---|---|
| 2011/0308778 | A1* | 12/2011 | Tsuda | F02M 26/32 165/157 |
| 2014/0311466 | A1 | 10/2014 | Schuricht et al. | |
| 2014/0373517 | A1* | 12/2014 | Sweet | F28F 9/02 60/324 |

FOREIGN PATENT DOCUMENTS

| | | | |
|---|---|---|---|
| JP | 4331679 | B2 | 9/2009 |
| JP | 2011-73046 | A | 4/2011 |
| JP | 2016-3832 | A | 1/2016 |
| KR | 20-0361349 | Y1 | 8/2004 |
| WO | WO 2004/001203 | A2 | 12/2003 |

* cited by examiner

COMBINATION STRUCTURE OF EGR COOLER

CROSS REFERENCE TO RELATED APPLICATION

The present application claims priority to Korean Patent Application No. 10-2016-0091911, filed Jul. 20, 2016, the entire contents of which is incorporated herein for all purposes by this reference.

BACKGROUND OF THE INVENTION

Field of the Invention

The present invention relates to a combination structure of an Exhaust Gas Recirculation (EGR) cooler that can reduce the manufacturing cost and time and ensure durability.

Description of Related Art

In the related art, there exists a flange for installing a gas tank of an EGR cooler which has a structure that allows for stable installation of a gas tank by increasing the strength of the joint between the gas tank and the flange by applying sufficient filler metal to braze the joint, and that can satisfy design dimensions after brazing by fixing the flange at an exact position when combined with the gas tank.

According to the main configuration of the flange for installing a gas tank of an EGR cooler which has a joint that is coupled to an end of a gas tank for an EGR cooler so that a gas tank can be fixed to a car body with the flange coupled to the gas tank, at the joint, a groove providing a space for applying filler metal for brazing is formed so that the joint can be coupled to the end of the gas tank, and a caulking groove for caulking the end of the gas tank is formed for temporary assembly before brazing the joint to the end of the gas tank.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a combination structure of an EGR cooler that can improve the durability of the EGR cooler and can reduce the manufacturing cost and time of the EGR cooler.

According to various aspects of the present invention, a combination structure of an Exhaust Gas Recirculation (EGR) cooler may include a housing open at both sides thereof, a plurality of headers inserted in both of the sides of the housing and having a circumference forming a layer with the housing, and a plurality of diffusers each including a coupling portion, which is inserted in the headers to form a layer with the housing and the headers, at a first side and having a hole for receiving and discharging exhaust gas at a second side, in which sides of the housing and the headers may be welded, and the housing, the circumference of the headers, and coupling portions of the diffusers may be welded.

Welding may be performed such that a first welded portion that is formed when the sides of the housing and the headers are welded and a second welded portion that is formed when the housing, circumference of the headers, and the coupling portions of the diffusers are welded do not overlap each other.

The first welded portion may be formed when the welding is performed from the sides of the housing and the headers, and the second welded portion may be formed when welding is performed from an outer side of the housing toward the circumference of the headers and the coupling portions of the diffusers.

The welding may be laser welding.

According to the combination structure of an EGR cooler described above, it is possible to reduce the time and cost for manufacturing an EGR cooler and ensure durability, so the quality can be improved and the commercial value of a vehicle can be increased.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
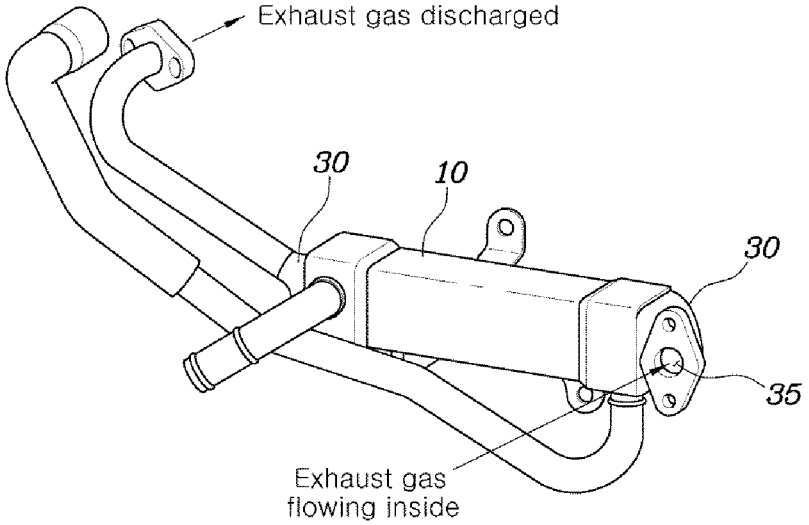
FIG. 1 is a view showing an EGR cooler according to various embodiments of the present invention.
Figure 2:
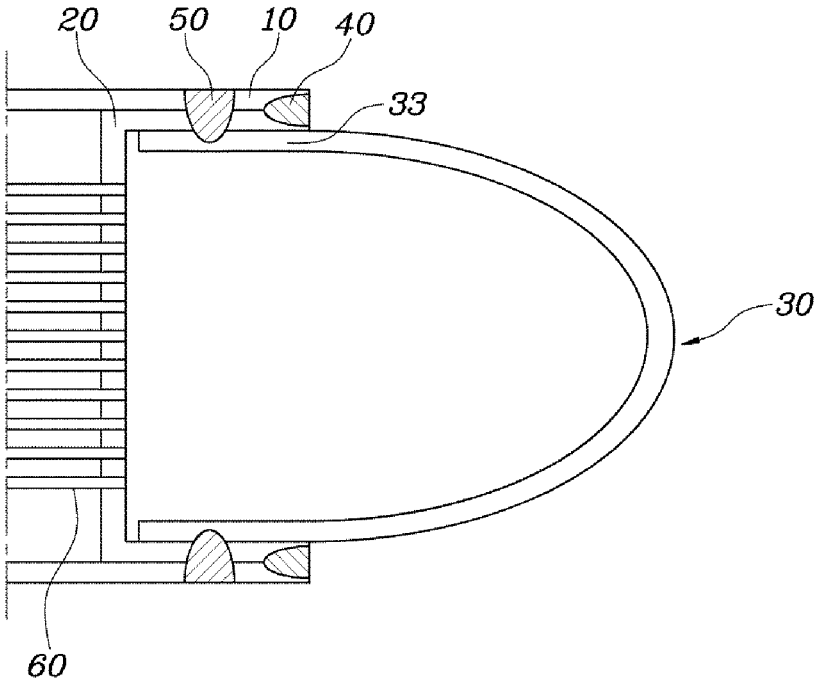
FIG. 2 is a view showing in detail a combination structure of the EGR cooler according to various embodiments of the present invention.

FIG. 1 is a view showing an EGR cooler according to various embodiments of the present invention and FIG. 2 is a view showing in detail a combination structure of an EGR cooler according to various embodiments of the present invention. Referring to FIGS. 1 and 2, a combination structure of an EGR cooler includes a housing 10 with both sides open, a plurality of headers 20 inserted in both sides of the housing 10 and having a circumference that forms a layer with the housing 10, and a plurality of diffusers 30 having a coupling portion 33, which is inserted in the headers 20 to make a layer with the housing 10 and the headers 20, at a first side and having a hole 35 for receiving and discharging exhaust gas at a second side, in which sides the housing 10 and the headers 20 are welded, and the housing 10, the circumference of the headers 20, and the coupling portion 33 of the diffusers 30 are welded.

An EGR cooler, as shown in FIG. 1, discharges exhaust gas through a diffuser 30 at a side of the housing 10 to receive some of the exhaust gas discharged from an exhaust manifold through a hole 35 in a diffuser 30 at another side of the housing 10, cool the exhaust gas with a coolant, and then send the gas back to an intake system. Accordingly, the combustion temperature in a cylinder decreases and the amount of nitrogen oxides (NOx) is reduced.

When the diffuser 30 is disposed at an inlet of exhaust gas, as shown in FIG. 2, it functions as a passage for distributing exhaust gas to the headers 20 for efficient heat exchange.

The headers 20 guide the exhaust gas flowing inside through the diffuser 30 into a tube 60 so that the exhaust gas exchanges heat with a coolant through the tube 60, whereby the exhaust gas can be cooled. In particular, the headers 20 prevent foreign substances from flowing into the tube 60.

On the other hand, when the diffuser 30 is disposed at an outlet of exhaust gas, it collects exhaust gas from the headers 20 and discharges the exhaust gas to the intake system.

The housing 10 covers the headers 20 and the tube 60 and enables coolant to flow around the tube 60, thereby cooling exhaust gas.

The various embodiments of the present invention are directed to providing a welding structure of the housing 10, the headers 20, and the diffusers 30, whereby it is possible to increase durability and reduce manufacturing costs and time.

In particular, according to various embodiments of the present invention, welding is performed such that a first welded portion 40, which is formed when sides of the housing 10 and the headers 20 are welded, and a second welded portion 50, which is formed when the housing 10, the circumference of the headers 20, and the coupling portions 33 of the diffusers 30 are welded, do not overlap each other. The welded portion means a portion including welded metal and a portion influenced by heat when welding is performed.

As in the related art, when the housing 10 and the headers 20 are welded and then the housing 10, the headers 20, and the diffusers are additionally welded at the same position, cracks are likely to form.

In detail, when double welding is performed, excessive heat is applied, so the welded portion is decreased in hardness and is softened, so cracks may be formed. Further, welding is performed with impurities during butt welding due to the oxides produced after primary welding of the housing 10 and the headers 20, so durability may be decreased.

Therefore, according to the present invention, welding is performed on the housing 10, the headers 20, and the diffusers 30 such that the welded portion do not overlap each other, so it is possible to prevent a decrease in the durability of an EGR cooler.

The first welded portion 40 is formed when welding is performed from the sides of the housing 10 and the headers 20 and the second welded portion 50 is formed when welding is performed from the outer side of the housing 10 toward the circumference of the headers 20 and the coupling portions 33 of the diffusers 30.

That is, as shown in FIG. 2, the primary welding is performed at sides of the housing 10 and the headers 20, thereby coupling the housing 10 and the headers 20. Thereafter, secondary welding is performed at a position where the housing 10, the headers 20, and the diffusers 30 make a layer and that is spaced apart from the position where the primary welding has been performed. In detail, as welding is performed from the outer side of the housing 10, the housing 10, the headers 20, and the diffusers 30 can be coupled.

Consequently, overlapping of the first welded portion 40 and the second welded portion 50 is avoided, so it is possible to prevent a decrease in durability attributable to double welding.

For reference, the welding may be laser welding in various embodiments of the present invention.

In the related art, nickel brazing has been generally used to ensure the coupling quality of an EGR cooler and ensure heat resistance and corrosion resistance. However, nickel brazing has problems in that the price of fillers is high and in that the processing time is also long, so productivity is low.

Therefore, according to various embodiments of the present invention, the parts of an EGR cooler are coupled by laser welding, so it is possible to ensure short processing time at a relatively low cost compared to nickel brazing, so the rate of production of an EGR cooler can be improved.

As a result, according to the combination structure of an EGR cooler described above, it is possible to reduce the time and cost for manufacturing an EGR cooler and ensure durability, so the quality can be improved and the commercial value of a vehicle can be increased.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A combination structure of an Exhaust Gas Recirculation (EGR) cooler, comprising:

a housing open at both sides thereof;

a plurality of headers having both sides and inserted in both of the sides of the housing and having a circumference forming a layer with the housing; and a plurality of diffusers each including a coupling portion, which is inserted in the headers to form a layer with the housing and the headers, at a first side and having a hole for receiving and discharging exhaust gas at a second side, wherein the sides of the housing and the sides of the headers are welded, and the housing, the circumference of the headers, and coupling portions of the diffusers are welded, wherein welding is performed such that a first welded portion is formed where distal ends of the housing and distal ends of the headers are welded and a second welded portion is formed where the housing, circumference of the headers, and the coupling portions of the diffusers are welded, and the first welded portion and the second welded portion are separated not to contact with each other, wherein when the headers are coupled to the housing, one flat side is formed by the distal ends of the headers and the distal ends of the housing in common and the first welded portion is formed by welding performed from a contact portion formed between the distal ends of the headers and the distal ends of the housing, the contact portion located in the flat side in a longitudinal direction of the housing, to connect the sides of the housing and the sides of the headers by the first welded portion, and wherein the second welded portion is formed by welding performed from an outer surface of the housing through the circumference of the headers to the coupling portions of the diffusers in a direction vertical to the outer surface to connect the housing, the headers, and the coupling portions of the diffusers by the second welded portion.

2. The structure of claim 1, wherein the welding comprises laser welding.

* * * * *